US011370147B2

(12) United States Patent
Span

(10) Patent No.: US 11,370,147 B2
(45) Date of Patent: Jun. 28, 2022

(54) PLATFORM WITH AN AUTONOMOUS POWERING ENGINE FOR MOUNTING ONTO A FIREWOOD SPLITTING APPARATUS

(71) Applicant: TAJFUN PLANINA PROIZVODNJA STROJEV D.O.O., Planina Pri Sevnici (SI)

(72) Inventor: Iztok Span, Ljubljana (SI)

(73) Assignee: TAJFUN PLANINA PROIZVODNJA STROJEV D.O.O., Planina Pri Sevnici (SI)

( * ) Notice: Subject to any disclaimer, the term of this patent is extended or adjusted under 35 U.S.C. 154(b) by 553 days.

(21) Appl. No.: 16/487,687

(22) PCT Filed: Apr. 9, 2018

(86) PCT No.: PCT/SI2018/000007
§ 371 (c)(1),
(2) Date: Aug. 21, 2019

(87) PCT Pub. No.: WO2018/194522
PCT Pub. Date: Oct. 25, 2018

(65) Prior Publication Data

US 2020/0055212 A1 Feb. 20, 2020

(30) Foreign Application Priority Data

Apr. 18, 2017 (SI) ..... P-201700111

(51) Int. Cl.
*B27L 7/00* (2006.01)
*F02B 63/04* (2006.01)

(52) U.S. Cl.
CPC ..... *B27L 7/00* (2013.01); *F02B 63/044* (2013.01); *F02B 2063/045* (2013.01)

(58) Field of Classification Search
CPC .... B27L 7/00; F02B 63/044; F02B 2063/045; F02B 63/00
See application file for complete search history.

(56) References Cited

U.S. PATENT DOCUMENTS 1,598,695 A * 9/1926 Lester ..... B27B 5/10 144/4.1
6,148,928 A 11/2000 Spears
2006/0180100 A1 8/2006 Nikolai

FOREIGN PATENT DOCUMENTS

CA 1084814 9/1980
DE 19507197 A1 9/1996
(Continued)

OTHER PUBLICATIONS

International Search Report and Written Opinion dated Jul. 20, 2018 issued in PCT App. No. PCT/SI2018/000007 (10 pages).

*Primary Examiner* — Jacob M Amick
*Assistant Examiner* — Charles J Brauch
(74) *Attorney, Agent, or Firm* — Haynes and Boone, LLP; William B. Nash

(57) ABSTRACT

A platform for mounting of an autonomous powering engine onto a firewood splitting apparatus includes a rigid bearing frame on which a powering engine is mounted. The engine is connected to a transmission, which is mechanically connected with a cardan coupling of a firewood splitting apparatus. The frame is arranged a distance apart from the ground and in a plane parallel to a plane defined by resting surfaces on supporting legs of a firewood splitting machine. The frame is furnished with two parallel and pivotal linear bearing beams that are pivotal around the axis that extends perpendicularly with respect to the plane of the frame and is pivotally connected with each corresponding connecting
(Continued)

seat to establish a detachable interconnection with each disposable bottom connecting seat on a firewood splitting apparatus.

14 Claims, 4 Drawing Sheets

(56) References Cited

FOREIGN PATENT DOCUMENTS

| | | | |
|---|---|---|---|
| EP | 1885631 | B1 | 2/2008 |
| EP | 1899244 | B1 | 3/2008 |
| EP | 1886027 | B1 | 12/2008 |
| EP | 2113160 | A1 | 11/2009 |

* cited by examiner

PLATFORM WITH AN AUTONOMOUS POWERING ENGINE FOR MOUNTING ONTO A FIREWOOD SPLITTING APPARATUS

CROSS REFERENCE TO RELATED APPLICATIONS

This application is a United States national phase application of co-pending international patent application number PCT/SI2018/000007, filed Apr. 9, 2018, which claims the benefit of Slovenia Patent Application No. P-201700111, filed Apr. 18, 2017, of which is hereby incorporated by reference in its entirety.

BACKGROUND

The present disclosure refers to a platform, which is suitable for mounting of an autonomous powering engine onto a firewood splitting apparatus and firewood splitting apparatus furnished with such platform. According to the International Patent Classification (IPC$^9$), the subject matter of the present disclosure belongs to the Class F 15 B 15/14.

The aim of the present disclosure is to create a platform, which could be in a detachable manner surmounted to an already known and existing firewood splitting apparatus, and which could on the one hand be suitable for mounting of an autonomous powering engine together with accompanying transmission suitable for connection with cardan coupling as well as with accessories for supplying the fuel or energy to said autonomous engine onto said firewood splitting apparatus, which can otherwise be optionally powered by means of a tractor engine via appropriate cardan coupling, while on the other hand such platform could also enable unhindered transporting of said autonomous powering engine together with the belonging transmission and other accompanying equipment without any essential enlargement of overall dimensions of said firewood splitting apparatus furnished with said autonomous powering engine.

A firewood splitting apparatus as such, namely a visual appearance thereof, is presented in SI-M-200350107, and various embodiments of such apparatuses are generally disclosed in DE 195 07 197 A1 or CA 1,084,814. Such prior art apparatus comprises a rigid frame, which is on the one hand suitable for placing of such device on each desired at least approximately horizontal location on the ground, and on the other hand also for transporting of the apparatus by means of a commonly used tractor, which is on its rear side furnished with an usual three-point connecting mechanism and with a cardan coupling suitable for driving of agricultural or forestry accessories by means of the tractor engine and via said cardan coupling. A longitudinal chute is available on said frame, which is suitable for receiving of each log section to be split and which is on its first terminal area furnished with a support for retaining said log section during splitting thereof, and which is on its residual terminal area furnished with a splitting blade, which is mounted on a movable part of a hydraulic cylinder, the stationary part of which is mechanically attached to said frame of the apparatus, while its movable part is connected with said splitting blade. Moreover, a driving assembly is mounted on said frame of the apparatus, which is disclosed in EP 1 886 027 B1 and to which a reference is made with regard to this application. Said driving assembly comprises a hydraulic circuit with a pump, which is via said cardan transmission driven by means of each tractor engine, as well as a reservoir for the hydraulic media and a control assembly, by means of which said hydraulic cylinder is properly supplied by the hydraulic media.

Such apparatus is optionally furnished with a saw, which is suitable for cutting each log to longitudinal sections of a predetermined length.

Besides, such apparatus is preferably adapted to cooperate with a further apparatus, which is disclosed in EP 1 885 631 B1 and serves for placing said longitudinal log sections into said chute, and optionally also with a telescopic band transporter, which is intended from transporting of the split firewood away from the apparatus and which is disclosed in EP 1 899 244 B1.

Such concept of any known firewood splitting apparatus enables to each user, who possesses a tractor with previously described performances, on the one hand to transport such apparatus to each desired location, where the logs, ready to be split, are available, together with accompanying apparatus for placing said log sections into the chute and a transporter for transporting the split firewood away from the apparatus by means of a commonly used tractor trailer, and on the other hand, as soon as the apparatus is placed on each desired location, also splitting said longitudinal log sections in order to produce firewood, which is then ready for use in furnaces, funnels or the like. Such apparatus may either be loaded onto a tractor trailer, or can also be attached either to the connecting mechanism on the rear side of a tractor, or even on the front side of the tractor, so that in such case the tractor is also ready for towing said trailer. As soon as the apparatus is placed on each desired location, it is prepared for operation by means of establishing interconnection with each tractor engine via each disposable cardan coupling. Such, each required pressure of the hydraulic media is established within the hydraulic circuit, which is required for controlling and operation of the splitting blade, and optionally also for operation of other disposable accessories, e.g. for transporting of firewood away from the apparatus, or for supplying of log sections into said chute on the firewood splitting apparatus, or the like.

However, in certain circumstances in the praxis there is a need, that said apparatus should be able to operate even when the tractor with its engine is not available closely to the apparatus i.e. within the range of the cardan coupling thereof. Namely, whenever the apparatus is used in situ, then the tractor cannot be exploited for any other purposes, for example for transporting of produced firewood e.g. by means of a trailer, or for preparing some further logs to be split, or the like, which is deemed to be a deficiency of such known firewood splitting apparatus.

In such cases, an autonomously operating powering engine should be added to such firewood splitting machine, like e.g. a gasoline or diesel internal combustion engine, or generally even an electric motor where appropriate energy source is available in situ, which is usually a huge problem or is even impossible. Those skilled in the art will understand, that surmounting can easily be added, however such upgraded apparatus would then be heavier, bulky and uncomfortable for both transporting along quite narrow forestry roads and operating in usual circumstances when the tractor engine is permanently present.

The present disclosure refers to a platform for mounting of an autonomous powering engine onto a firewood splitting apparatus, namely of engine, which is able to operate independently with regard to each tractor engine.

According to the present disclosure, said platform comprises a rigid bearing frame, on the top surface of which at least one engine is mounted, which is capable to operate autonomously i.e. independently on each powering means available on a tractor and is furnished with a fuel reservoir or any other source for supplying energy to said engine, which is furthermore mechanically connected to a transmission, which is suitable for receiving a torque there-from and which is furthermore also with the possibility of transferring said torque optionally connectable with a cardan joint of a firewood splitting apparatus. Said frame is arranged at certain distance above each ground and in a plane, which extends at least approximately parallel with to plane as defined by resting surfaces of supporting legs on said firewood splitting apparatus. Moreover, said frame is on its bottom surface furnished with linear pivotal bearing beams, which extend parallel with each other and are each per se on their end portions faced towards the frame and are pivotally around the axis, which extend perpendicularly with regard to the dominant plane of said frame, connected with said frame, and each of said beams is on its opposite end portion, which protrudes away from the area of said frame, pivotally around the axis, which extends perpendicularly with respect to said dominant plane of the frame, connected with each belonging connecting seat, which is adjusted for establishing of a detachable interconnection between each disposable bottom connecting seats of a firewood splitting apparatus by means of at least two bolts, which are arranged apart of each other and parallel with each other and are each per se insertable through suitable bores and secured from undesired removal there-from. Said pivotal interconnection between each bearing beam and each corresponding connecting seat is arranged in such manner that said pivoting can be temporarily disabled by means of fixation of a bearing beam in each desired position thereof.

Said pivotal interconnection between each bearing beam and said bearing frame of the platform is arranged by means of freely rotatable hinges, while the pivotal interconnection between each bearing beam and each belonging connecting seat is arranged by means of hinges, at least one of which is adjusted to be fixed in each desired position.

Consequently, for the purposes of blocking said hinge in each desired position, each of relatively to each other rotatable parts of the hinge on the bearing beam and on the connecting seat is furnished with a flange, which is furnished with a plurality of throughout bores, which are equidistantly arranged along the circumference thereof, so that said bolt is insertable through two coinciding bores on said flanges on the bearing beam and the connecting seat.

Moreover, each of said connecting seats is furnished with bores, which are spaced apart from each other and adapted for establishing interconnection with the bottom connecting seat of a firewood splitting apparatus by means of a bolt and in view of its construction concept and dimensions corresponds to a bottom connecting seat of a tractor three-point connecting mechanism, to which the firewood splitting apparatus is detachably connectable in the area of the bottom connecting seat.

Said cardan coupling on said transmission means in view of construction concept and dimensions corresponds to a tractor cardan coupling, by which via appropriate cardan transmission said firewood splitting apparatus is connectable. The platform can be adjusted to be furnished with various types of autonomous motors, and the powering engine can e.g. be either an internal combustion engine, which is selected from a group, consisting of two- or four stroke gasoline engines, diesel engines and gas engines, or optionally also an electric motor.

The present disclosure also refers to a firewood splitting apparatus, which is due to providing an autonomous powering engine without any need to the presence of the tractor engine, which has otherwise normally been required, furnished with a platform with previously disclosed features. Such apparatus comprises a rigid frame with supporting legs, which is on the one hand adjusted for placement of the apparatus on each desired at least approximately horizontal ground area, and on the other hand for the purposes of transporting of the apparatus by means of a commonly used tractor, which is on its rear side furnished with a common three-point connecting mechanism as well as with a cardan coupling suitable for driving of agricultural or forestry accessories by means of each tractor engine and via corresponding cardan shaft. A longitudinal chute is available on said frame of said firewood splitting apparatus and is adjusted for receiving each log, which is to be split, and a saw is mounted in the area of said chute, which is adjusted for cutting of logs to longitudinal sections of a predetermined length, wherein said chute is on its one terminal portion furnished with a support suitable for retaining said log section by performing splitting thereof, and on the other end portion with a splitting blade, which is displaceable to and fro in the longitudinal direction of the apparatus and is attached to a movable part of a hydraulic cylinder, the stationary part of which is mechanically connected with said frame of the apparatus. Said cutting blade is therefore connected with said movable part of the hydraulic cylinder. For the purposes of establishing each detachable mechanical connection with said common three-point mechanism on each tractor, said bearing frame of such apparatus is furnished with an upper connecting seat, which comprises a pair of eyes, which are parallel with each other and spaced apart from each other and are moreover each per se furnished with coaxial throughout passages, through which a bolt is insertable, which is secured against undesired removal, and moreover, said frame is also furnished with a pair of bottom connecting seats, each of them also comprises a pair of connecting eyes, which are in parallel spaced apart from each other and are each per se furnished with coaxial throughout bores, through which a bolt is insertable, which is secured against undesired removal, and moreover, said frame is also furnished with a cardan coupling, which is suitable to be interconnected with a cardan shaft and upon that for transmission of torque from each complementary cardan coupling on the tractor. Moreover, said frame is also furnished with a hydraulic driving assembly, comprising a hydraulic circuit with a pump, which is via said cardan coupling and cardan transmission powered by means of a tractor engine, as well as with a reservoir for hydraulic media together with corresponding control assembly, through which said hydraulic cylinder, to which said splitting blade is attached, is supplied by said hydraulic media.

The apparatus of the previously disclosed art is characterized in that at least in the area of said bottom connecting seats each of said connecting eyes is furnished with two apart from each other spaced throughout passages, so that in each case one passage on the one eye as well as on the residual eye are arranged coaxially with each other and herewith adapted to receive a bolt, which is optionally secured against undesired removal. Moreover, such apparatus is also furnished with a platform with previously features, which is by means of said bolts in a detachable manner connectable to said apparatus at least in the area of said bottom connecting seats.

Said pivotal interconnection between each bearing beam and said bearing frame of the platform is arranged by means of freely rotatable hinges, while the pivotal interconnection between each bearing beam and each belonging connecting seat is arranged by means of hinges, at least one of which is adjusted to be fixed in each desired position. Correspondingly, for the purposes of blocking of said hinge in each desired position each of relatively to each other rotatable parts of the hinge on the bearing beam and on the connecting seat is furnished with a flange, which is furnished with a plurality of throughout passages, which are equidistantly arranged along the circumference thereof, so that a bolt is insertable through two coinciding bores on said flanges in the bearing beam and the connecting seat. Moreover, each of said connecting seats is furnished with bores, which are adapted for establishing interconnection with the bottom connecting seat of a firewood splitting apparatus by means of a bolt and in view of its construction concept and dimensions corresponds to a bottom connecting seat of a tractor three-point connecting mechanism, to which the firewood splitting apparatus is detachably connectable in the area of the bottom connecting seat. The cardan coupling on said transmission means in view of construction concept and dimensions corresponds to a tractor cardan coupling, by which via appropriate cardan transmission said firewood splitting apparatus is connectable. Such platform can be adapted to be furnished with various types of autonomous driving means, wherein the powering engine can either be an internal combustion engine, which is selected from a group, consisting of two- or four stroke gasoline engines, diesel engines and gas engines, or also an electric motor.

DRAWINGS

Now the present disclosure will be described on the basis of an embodiment, which is presented in the attached drawings, in which FIG. 1 is a platform for mounting of an autonomous powering engine onto a firewood splitting apparatus, shown in a bottom/front isometric view;

Figure 1:
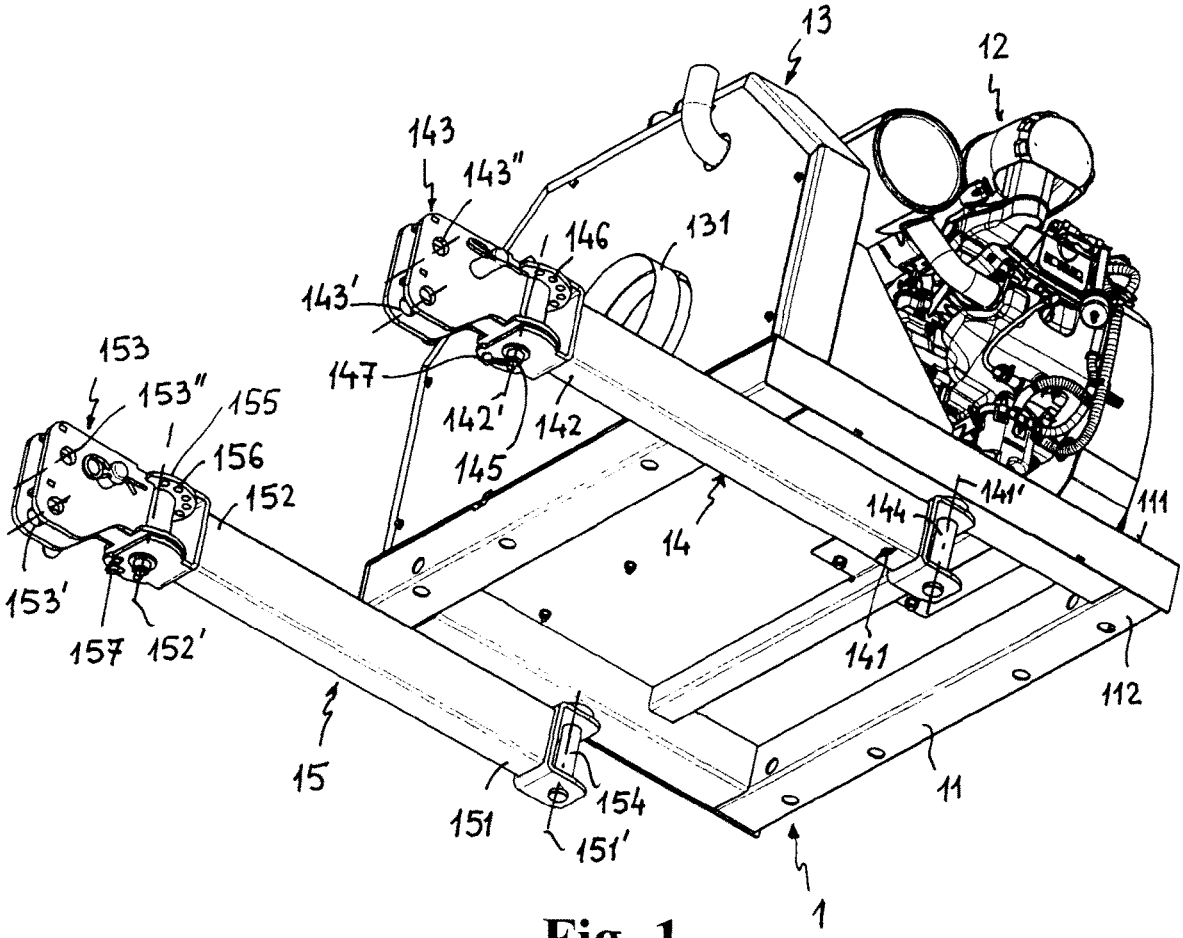
Figure 3:
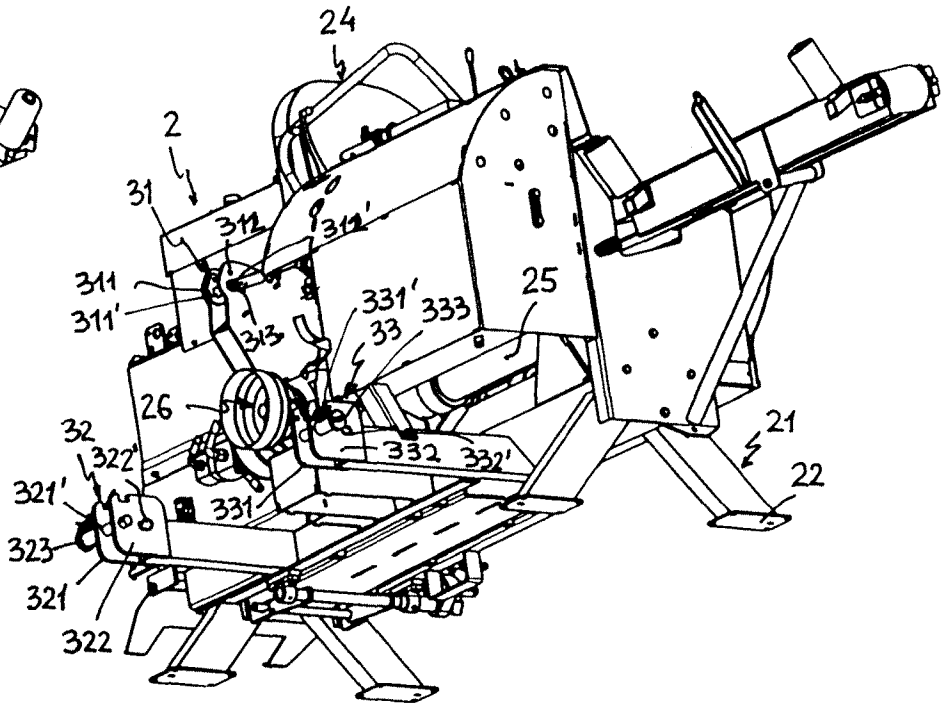
FIG. 3 is the apparatus according to FIG. 2, shown in a bottom/side isometric view.
Figure 2:
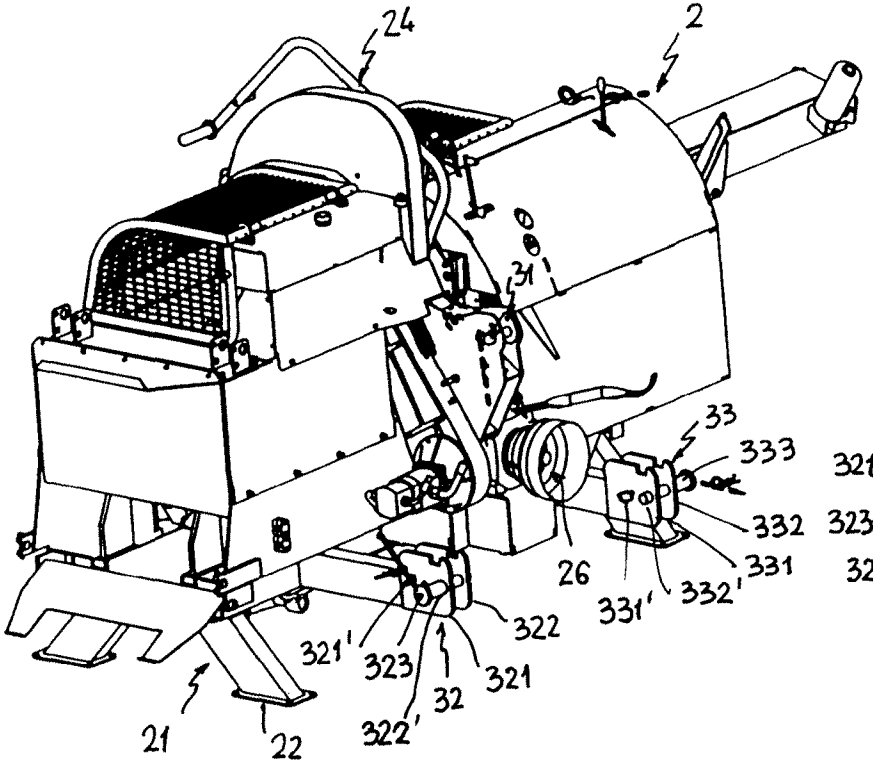
FIG. 2 is a known firewood splitting apparatus, shown in a top/side isometric view.
Figures 4, 5:
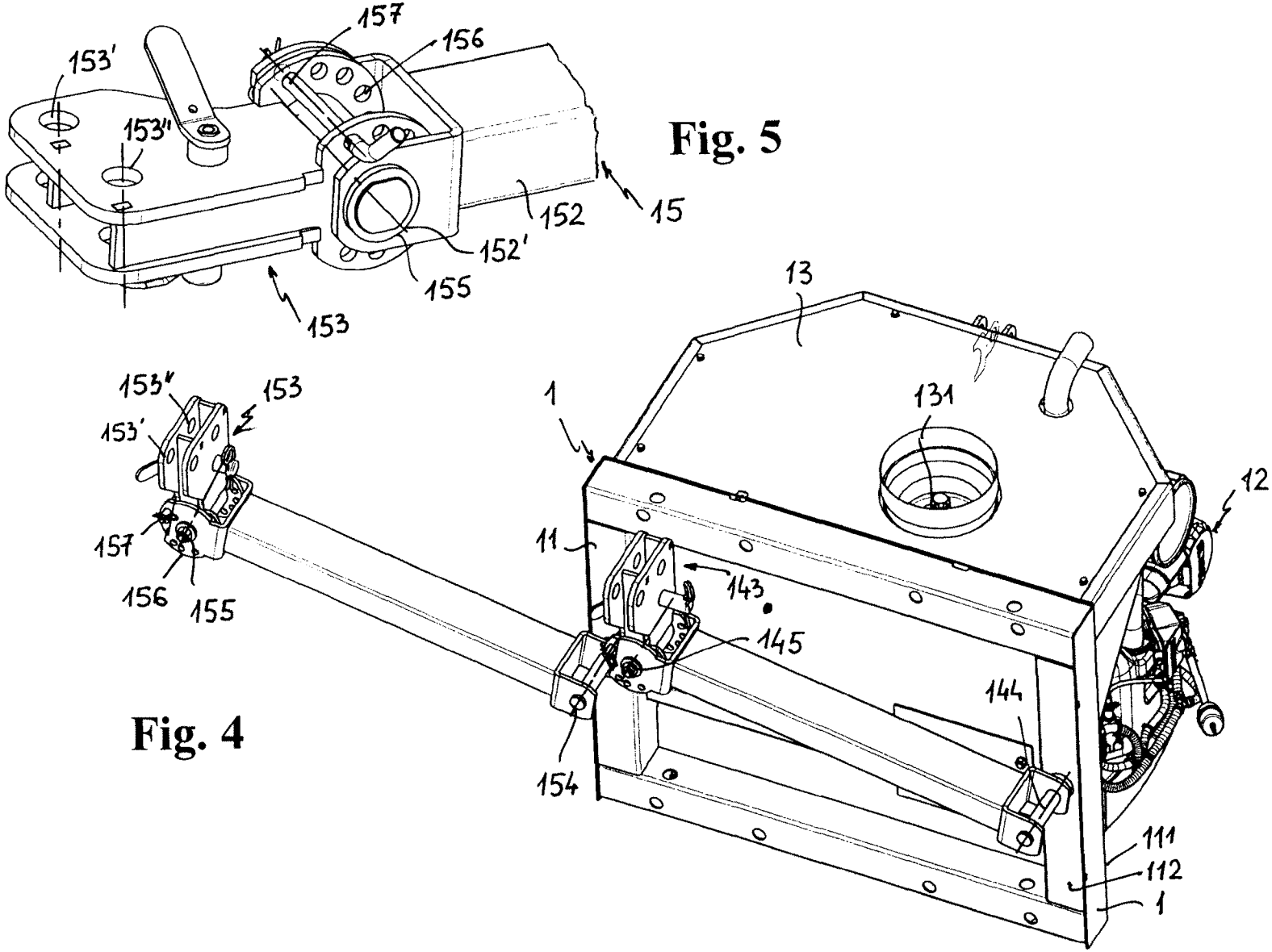
FIG. 4 is the platform according to FIG. 1, shown in a bottom/side isometric view.
FIG. 5 is a detailed presentation of a connecting seat according to FIGS. 1 and 4.
Figure 6:
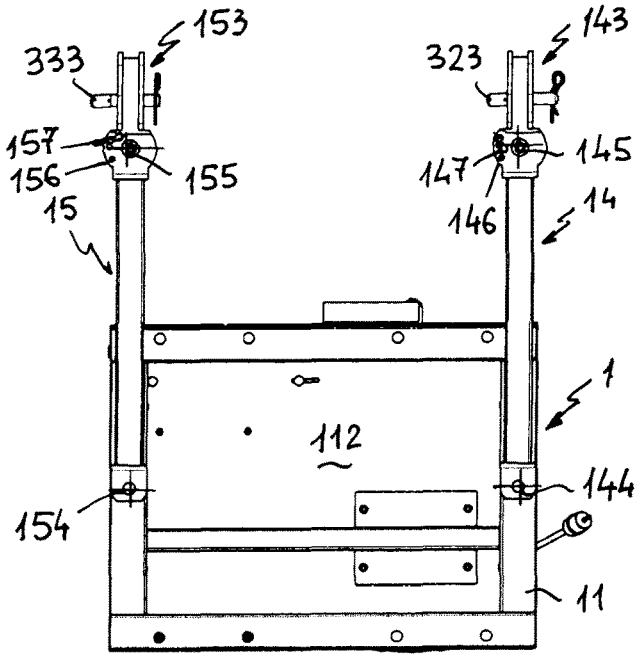
FIG. 6 is a platform according to FIGS. 1 and 4, when observed from its bottom side and in position, in which the platform frame is pivoted away from the apparatus according to FIGS. 2 and 3.
Figure 7:
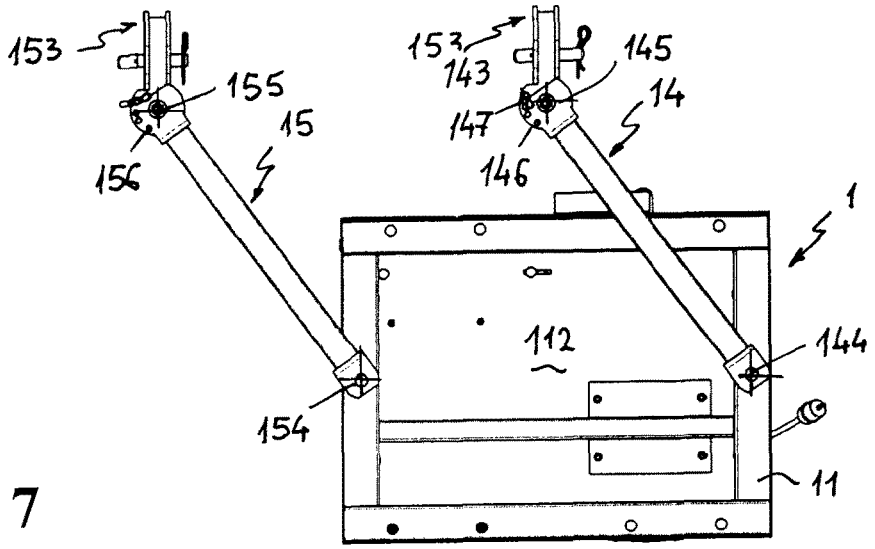
Figure 8:
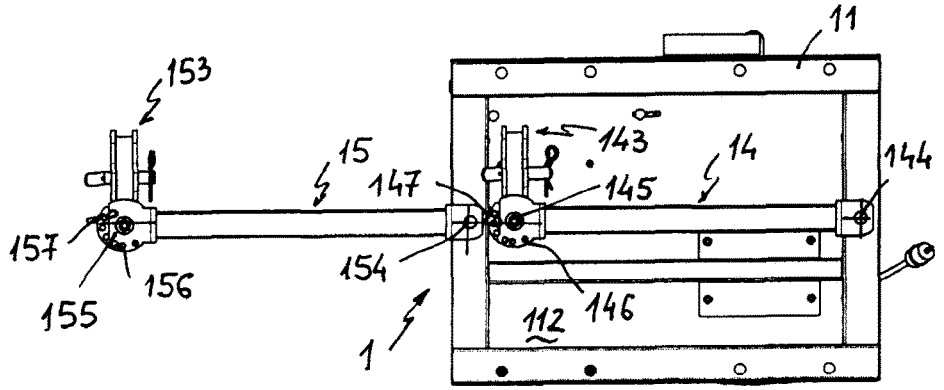

FIG. 7 is a platform according to FIGS. 1 and 4, when observed from its bottom side and in position, in which the platform frame is positioned some closer to the apparatus according to FIGS. 2 and 3 than in FIG. 6; and FIG. 8 is a platform according to FIGS. 1 and 4, when observed from its bottom side and in position, in which the platform frame is located adjacent to the apparatus according to FIGS. 2 and 3.

DETAILED DESCRIPTION

A platform 1 for mounting of an autonomous powering engine onto a firewood splitting apparatus 2 is shown in FIG. 1 and FIGS. 4-8.

Said platform comprises a rigid bearing frame 11, on the top surface 111 of which at least one autonomously operating engine 12 is mounted, which is capable to operate autonomously i.e. independently on each powering means available on a tractor. Said motor 12 is furnished with a fuel reservoir or any other source for supplying energy to said engine. The motor 12 is furthermore mechanically and with the possibility of transmission of torque, e.g. by means of a clutch or any other suitable shaft transmission connected to a transmission 13, which is further also with the possibility of transferring said torque optionally connectable with a cardan joint 26 of a firewood splitting apparatus 2, namely in a need, or when the apparatus is powered by means of said engine 12 and not by means of a tractor engine.

Said frame 11 of the platform 1 is arranged at certain distance above each ground and in a plane, which extends at least approximately parallel with to plane as defined by resting surfaces 22 of supporting legs 21 on said firewood splitting apparatus 1.

Moreover, said frame 11 is on its bottom surface 112 furnished with pivotal linear bearing beams 14, 15, which extend parallel with each other and are each per se on their end portions 141, 142 faced towards the frame 11 and are pivotally around the axis 141', 151', which extends perpendicularly with regard to the dominant plane of said frame 11, connected with said frame 11, and each of said beams 14, 15 is on its opposite end portion 142, 152, which protrudes away from the area of said frame 11, pivotally around the axis 142', 152', which also extends perpendicularly with respect to said dominant plane of the frame 11, connected with each belonging connecting seat 143, 153, which is adjusted for establishing of a detachable interconnection between each disposable bottom connecting seats 32, 33 of a firewood splitting apparatus 2 by means of at least two bolts 323, 333, which are arranged apart of each other and parallel with each other and are each per se insertable through suitable bores 321', 322'; 331', 332' and secured from undesired removal there-from.

Said pivotal interconnection between each bearing beam 14, 15 and each corresponding connecting seat 143, 153 is arranged in such manner that said pivoting can be temporarily disabled by means of fixation of a bearing beam 14, 15 in each desired position thereof.

In the shown embodiment of the platform 1 according to FIG. 1, said pivotal interconnection between each bearing beam 14, 15 and said bearing frame 11 of the platform 1 is arranged by means of freely rotatable hinges 144, 154, while the pivotal interconnection between each bearing beam 14, 15 and each belonging connecting seat 143, 153 is arranged by means of hinges 145, 155, at least one of which is adjusted to be fixed in each desired position.

For the purposes of blocking said hinge 145, 155 in each desired position, each of relatively to each other rotatable parts of the hinge on the bearing beam 14, 15 and on the connecting seat 143, 153 is furnished with a flange, which is furnished with a plurality of throughout bores 146, 156, which are equidistantly arranged along the circumference thereof, so that said bolt 147, 157 is insertable through two coinciding bores 146, 156 on said flanges on the bearing beam 14, 15 and the connecting seat 143, 153.

Moreover, each of said connecting seats 143, 153 is furnished with bores 143', 143"; 153', 153", which are spaced apart from each other and adapted for establishing interconnection with the bottom connecting seat 32, 33 of a firewood splitting apparatus 2 by means of a bolt 323, 333 and in view of its construction concept and dimensions corresponds to a bottom connecting seat 32, 33 of a tractor three-point connecting mechanism, to which the firewood splitting apparatus 2 is detachably connectable in the area of the bottom connecting seat 32, 33.

The present disclosure also provides that said cardan coupling 131 on said transmission means 13 in view of construction concept and dimensions corresponds to a tractor cardan coupling, by which via appropriate cardan transmission said firewood splitting apparatus 2 is connectable.

Said autonomous powering engine 12 can e.g. be either an internal combustion engine, which is selected from a group, consisting of two- or four stroke gasoline engines, diesel engines and gas engines, or optionally also an electric motor. Choice of the motor depends on circumstances, namely on each expected requirements about the level of autonomy of the powering means and also on each available energy source for powering said engine 12. Those skilled in the art will understand that choice of each desired powering engine 12 is not limiting in the sense of the scope of the present disclosure, and that present disclosure may refer to any powering engine 12, including fuel cells, turbine engines or any other non-conventional driving means, by which (thanks to said platform 1 according to the present disclosure) each firewood splitting apparatus can be furnished.

The present disclosure also refers to a firewood splitting apparatus 2 as such, in combination with a platform having previously disclosed features. Such apparatus 2 comprises a rigid frame 21 with supporting legs 22, which is on the one hand adjusted for placement of the apparatus on each desired at least approximately horizontal ground area, and on the other hand for the purposes of transporting of the apparatus by means of a common tractor, which is on its rear side furnished with a common three-point connecting mechanism as well as with a cardan coupling suitable for driving of agricultural or forestry accessories by means of each tractor engine and via corresponding cardan shaft, wherein a longitudinal chute 23 is available on said frame 21 of the firewood splitting apparatus 2 and is adjusted for receiving each log, which is to be split, and wherein a saw 24 is optionally mounted in the area of said chute, which is adjusted for cutting of logs to longitudinal sections of a predetermined length, and wherein said chute 23 is on its one terminal portion furnished with a support suitable for retaining said log section by performing splitting thereof, and on the other terminal portion with a splitting blade, which is displaceable to and fro in the longitudinal direction of the apparatus and is attached to a movable part of a hydraulic cylinder 25, the stationary part of which is mechanically connected with said frame 21 of the apparatus 2, while its movable part is connected with said blade.

Said frame 21 is for the purposes of establishing each detachable mechanical connection with said common three-point mechanism on each tractor furnished with an upper connecting seat 31, comprising a pair of eyes 311, 312, which are in parallel spaced apart from each other and each per se furnished with coaxial throughout passages 311', 311", through which a bolt (313) is insertable, which is secured against undesired removal, and moreover, said frame is also furnished with a pair of bottom connecting seats 32, 33, each of them also comprises a pair of connecting eyes 321, 322; 331, 332, which are in parallel spaced apart from each other and are each per se furnished with coaxial throughout bores 321', 322'; 321", 322", through which a bolt 323, 333 is insertable, which is secured against undesired removal, and moreover, said frame 21 is also furnished with a cardan coupling 26, which is suitable to be interconnected with a cardan shaft and upon that for transmission of torque from each complementary cardan coupling on the tractor, and moreover, said frame 21 is also furnished with a hydraulic driving assembly 27, comprising a hydraulic circuit with a pump, which is via said cardan coupling 26 and cardan transmission powered by means of a tractor engine, as well as with a reservoir for hydraulic media together with corresponding control assembly, through which said hydraulic cylinder 25, to which said splitting blade is attached, is supplied by said hydraulic media. Such apparatus is characterized in that at least in the area of said bottom connecting seats 32, 33 each of said connecting eyes 321, 322 is furnished with two apart from each other spaced throughout passages 321', 322'; 331', 332', so that in each case one passage 321', 322'; 331', 332' on the one eye 321, 331 as well as on the residual eye 322, 332 are arranged coaxially with each other and herewith adapted to receive a bolt 323, 333, which is optionally secured against undesired removal. In addition to that, the present disclosure also provides that said apparatus is furnished with a platform with previously described features, which is by means of said bolts 323, 333 in a detachable manner connectable to said apparatus 2 at least in the area of said bottom connecting seats 32, 33.

What is claimed is:

1. A platform for mounting of an autonomous powering engine onto a firewood splitting apparatus, comprising:

a rigid bearing frame on the top surface of which at least one engine is mounted, wherein the rigid bearing frame is:

capable to operate autonomously and independently on each powering means available on a tractor;

furnished with a energy source that is configured to supply energy to said engine that is furthermore mechanically connected to a transmission and configured to receive a torque there-from and transfer said torque with a cardan joint of a firewood splitting apparatus, wherein said frame is arranged at a distance above each ground and in a plane which extends at least approximately parallel with a plane defined by resting surfaces of supporting legs on said firewood splitting apparatus, and wherein said frame is on its bottom surface furnished with linear pivotal bearing beams, which extend parallel with each other and are each on their end portions faced towards the frame pivotally around the axis that extends perpendicularly with regard to the dominant plane of said frame, connected with said frame, while each of said beams is on its opposite end portion that protrudes away from the area of said frame, pivotally around the axis that extends perpendicularly with respect to said dominant plane of the frame and is connected with each belonging connecting seat that is adjusted for establishing a detachable interconnection between each disposable bottom connecting seat of a firewood splitting apparatus using at least two bolts, which are arranged apart of each other and parallel with each other and are each insertable through suitable bores and secured from undesired removal there-from, and wherein said pivotal interconnection between each bearing beam and each corresponding connecting seat is arranged such that said pivoting can be temporarily disabled by means of fixation of a bearing beam in each desired position thereof.

2. The platform according to claim 1, wherein said pivotal interconnection between each bearing beam and said bearing frame of the platform is arranged by means of freely rotatable hinges, while the pivotal interconnection between each bearing beam and each belonging connecting seat is arranged by means of hinges, at least one of which is adjusted to be fixed in each desired position.

3. The platform according to claim 2, wherein, for the purposes of blocking of said hinge in each desired position, each of relatively to each other rotatable parts of the hinge on the bearing beam and on the connecting seat is furnished with a flange, which is furnished with a plurality of throughout bores which are equidistantly arranged along the circumference thereof such that said bolt is insertable through two coinciding bores on said flanges on said bearing beam and said connecting seat.

4. The platform according to claim 1, wherein each of said connecting seats is furnished with bores which are spaced apart from each other and adapted for establishing interconnection with the bottom connecting seat of a firewood splitting apparatus by means of a bolt and corresponds to a bottom connecting seat of a tractor three-point connecting mechanism to which the firewood splitting apparatus is detachably connectable in the area of the bottom connecting seat.

5. The platform according to claim 1, wherein said cardan coupling on said transmission means corresponds to a tractor cardan coupling by which via appropriate cardan transmission said firewood splitting apparatus is connectable.

6. The platform according to claim 1, wherein said powering engine is an internal combustion engine, which is selected from a group consisting of two- or four stroke gasoline engines, diesel engines, and gas engines.

7. The platform according to claim 1, wherein said powering engine is an electric motor.

8. A firewood splitting apparatus, comprising:

a rigid frame with supporting legs adjusted for placement of the apparatus on at least approximately horizontal ground area for the purposes of transporting of the apparatus by means of a common tractor which is on its rear side furnished with a common three-point connecting mechanism as well as with a cardan coupling suitable for driving of agricultural or forestry accessories by means of each tractor engine and via corresponding cardan shaft, wherein a longitudinal chute is available on said frame of said firewood splitting apparatus and is adjusted for receiving each log that is to be split, and wherein a saw mounted in the area of said chute and is adjusted for cutting of logs to longitudinal sections of a predetermined length, and wherein said chute is on its one terminal portion furnished with a support suitable for retaining said log section by performing splitting thereof, and on the other end portion with a splitting blade that is displaceable in the longitudinal direction of the apparatus and is attached to a movable part of a hydraulic cylinder that includes a stationary part which is mechanically connected with said frame of the apparatus while its movable part is connected with said blade, and wherein said frame is for the purposes of establishing each detachable mechanical connection with said common three-point mechanism on each tractor furnished with an upper connecting seat, comprising:

a pair of eyes that are in parallel spaced apart from each other and each per se furnished with coaxial throughout passages, through which a bolt is insertable, which is secured against undesired removal, and moreover, said frame is also furnished with a pair of bottom connecting seats each of which also comprises a pair of connecting eyes that are in parallel spaced apart from each other and are each furnished with coaxial throughout bores through which a bolt is insertable, and which is secured against undesired removal, and wherein said frame is also furnished with a cardan coupling that is suitable to be interconnected with a cardan shaft and configured to transmit torque from each complementary cardan coupling on the tractor, and wherein said frame is also furnished with a hydraulic driving assembly that includes a hydraulic circuit with a pump, which is powered via said cardan coupling and cardan transmission by means of a tractor engine, as well as includes a reservoir for hydraulic media together with corresponding control assembly through which said hydraulic cylinder, to which said splitting blade is attached, is supplied by said hydraulic media, and wherein:

at least in the area of said bottom connecting seats, each of said connecting eyes is furnished with two spaced apart throughout passages such that one passage on the one eye as well as on the residual eye are arranged coaxially with each other and adapted to receive a bolt that is secured against undesired removal, wherein said apparatus is furthermore furnished with a platform which is secured by means of said bolts in a detachable manner connectable to said apparatus at least in the area of said bottom connecting seats.

9. The apparatus according to claim 8, wherein said pivotal interconnection between each bearing beam and said bearing frame of the platform is arranged by means of freely rotatable hinges, while the pivotal interconnection between each bearing beam and each belonging connecting seat is arranged by means of hinges, at least one of which is adjusted to be fixed in each desired position.

10. The apparatus according to claim 9, wherein for the purposes of blocking of said hinge in each desired position, each rotatable parts of the hinge on the bearing beam and on the connecting seat is furnished with a flange that is furnished with a plurality of throughout passages that are equidistantly arranged along the circumference thereof such that a bolt is insertable through two coinciding bores on said flanges in the bearing beam and the connecting seat.

11. The apparatus according to claim 8, wherein each of said connecting seats is furnished with bores that are adapted for establishing interconnection with the bottom connecting seat of a firewood splitting apparatus by means of a bolt that corresponds to a bottom connecting seat of a tractor three-point connecting mechanism to which the firewood splitting apparatus is detachably connectable in the area of the bottom connecting seat.

12. The apparatus according to claim 8, wherein said cardan coupling on said transmission means corresponds to a tractor cardan coupling via which an appropriate cardan transmission said firewood splitting apparatus is connectable.

13. The apparatus according to claim 8, wherein said powering engine is an internal combustion engine that is selected from a group consisting of two- or four stroke gasoline engines, diesel engines, and gas engines.

14. The apparatus according to claim 8, wherein said powering engine is an electric motor.

* * * * *